US006003358A

United States Patent [19]

Lipari et al.

[11] Patent Number: 6,003,358

[45] Date of Patent: Dec. 21, 1999

[54] METHOD AND APPARATUS FOR FORMING BENDS IN A SELECTED SEQUENCE

[75] Inventors: B. J. Lipari, Evergreen; Gabriel Kohlmann, Highlands Ranch; Thomas Shilling, Denver; John W. Schwab, Golden; Roman L. Tankelevich, Lakewood, all of Colo.

[73] Assignee: Laser Products, Inc., Oak Ridge, Tenn.

[21] Appl. No.: 08/740,167

[22] Filed: Oct. 22, 1996

[51] Int. Cl.[6] ..... B21J 11/00

[52] U.S. Cl. ..... 72/404; 72/14.8; 72/16.1; 72/307; 72/217; 72/447

[58] Field of Search ..... 72/14.8, 15.2, 72/16.1–16.4, 17.3, 18.1, 18.2, 31.01, 31.1, 31.11, 31.12, 294, 306, 307, 384, 399, 403, 404, 446, 447, 217, 388

[56] References Cited

U.S. PATENT DOCUMENTS

| | | | |
|---|---|---|---|
| 4,117,702 | 10/1978 | Foster | 72/7 |
| 4,232,540 | 11/1980 | Cain | 72/11 |
| 4,280,350 | 7/1981 | King | 72/7 |
| 4,624,121 | 11/1986 | Kitsukawa et al. | 72/65 |
| 4,662,204 | 5/1987 | Saegusa | 72/306 |
| 4,702,097 | 10/1987 | Zahlaus | 72/306 |
| 4,739,643 | 4/1988 | Kuriyama et al. | 72/306 |
| 4,910,984 | 3/1990 | Young | 72/7 |
| 4,920,779 | 5/1990 | Post | 72/7 |
| 4,945,747 | 8/1990 | Yogo | 72/306 |
| 4,993,253 | 2/1991 | Del Fabro et al. | 72/307 |
| 5,099,669 | 3/1992 | Del Fabro | 72/307 |
| 5,113,683 | 5/1992 | Lafrasse | 72/306 |
| 5,199,292 | 4/1993 | Del Fabro et al. | 72/307 |
| 5,216,913 | 6/1993 | Post | 72/446 |
| 5,259,231 | 11/1993 | Kutschker | 72/319 |
| 5,297,415 | 3/1994 | Hendricks | 72/369 |
| 5,335,529 | 8/1994 | Crowdus et al. | 72/404 |
| 5,461,893 | 10/1995 | Tyler | 72/307 |
| 5,542,283 | 8/1996 | Post | 72/446 |
| 5,566,565 | 10/1996 | Saegusa | 72/306 |

OTHER PUBLICATIONS

Power–Trac Ball Screw Design Guide of Nook Industries, Inc.

Actionjac Electric Cylinder Actuator Design Guide of Nook Industries, Inc.

Bimba Linear Thruster catalog.

Industrial Devices Corporation Electric Linear Actuators and Controls brochure, 1996.

Kollmorgen Motion Technologies Group, The Kollmorgen Guide to Motion Control Product Catalog.

Parker Motion & Control Step Motor & Servo Motor Systems and Controls, 1996/1997 Catalog.

*Primary Examiner*—Joseph J. Hail, III

*Attorney, Agent, or Firm*—Sheridan Ross P.C.

[57] ABSTRACT

The present invention relates generally to bending a workpiece to form a desired configuration and, in particular, to a method and apparatus for forming bends "out of sequence," i.e., in a time sequence different from the spatial sequence of the bends on the workpiece. The apparatus of the present invention include a bending system for bending a workpiece and a positioning system for positioning the workpiece relative to a bending region so that bends can be formed in various locations across the bending region. By virtue of the disclosed structures, a series of bends can be formed on a workpiece at various locations within the bending region. Bends can be formed out sequence and without advancing the workpiece relative to the bending region.

34 Claims, 11 Drawing Sheets

METHOD AND APPARATUS FOR FORMING BENDS IN A SELECTED SEQUENCE

FIELD OF THE INVENTION

The present inventions relate generally to bending a workpiece to form a desired configuration and, in particular, to a method and apparatus for forming bends either in a sequential manner or "out-of-sequence", i.e., in a time sequence different from the spatial sequence of the bends on the workpiece. The inventions are applicable to a variety of malleable materials, including metallic and non-metallic materials, and to various profile types including strips, rods, tubes, pipes, linear or planer workpieces and the like.

BACKGROUND OF THE INVENTION

Many systems for bending workpieces to form a desired configuration have been devised. In such systems, the workpiece is typically driven past a bending station such that the workpiece is formed into the desired configuration beginning at one end and progressing at intervals along the length of the workpiece until the configuration is completed. The bends are thus formed in a time sequence corresponding to the spatial sequence of the bends on the workpiece.

A number of different types of bending tools may be employed at the bending stations of such devices including, for example, brake presses, mandrel and wiper bending tools, and roller arrays, e.g., three or more bending rollers arranged in a pyramid or triangular array. In a brake press, the workpiece is pressed between appropriately shaped dies to form the bend. In mandrel and wiper bending, the wiper is moved so as to cause the workpiece to bend about the mandrel. In roller array systems, at least one of the rollers can ordinarily be moved relative to adjacent rollers so that the curvature of the resulting bend in the workpiece pressed between the rollers can be varied.

SUMMARY OF THE INVENTION

It has been recognized that conventional bending systems do not fully address the needs of certain industrial bending applications. In particular, such conventional systems are generally not adapted for use in forming a variety of workpiece configurations, of either a complex or simple nature, which involve sequential or out-of-sequence bends and/or where workpiece movement is limited, which accommodate a range of workpiece sizes from small to large—requiring mechanical intervention to move, on a variety of workpiece materials.

One such industrial application relates to bending elongate strips of metal to form complicated configurations. For example, in the sign industry, a strip of metal can be bent to form the side wall of a neon tube housing. Because such housings may take the form of a custom design, artwork or letters of various sizes and fonts, the side wall configuration varies dramatically from case to case.

In order to accommodate the demands of such applications, it is preferable that the bending system employed be readily capable of forming bends of a variety of shapes including corners and smooth curves. Moreover, in order to more nearly achieve full automation or operate in limited space, it is desirable that the bending system not only be capable of forming bends in a sequential fashion, but also in an order out of sequence. In this regard, it will be appreciated that some configurations are problematic in that an attempt to sequentially form the configuration bends, i.e., beginning at one end of the workpiece and progressing a long the length of the workpiece until the configuration is completed, results in mechanical interference between portions of the workpiece or between the workpiece and the bending machinery. Such interference can often be reduced or eliminated by forming the bends out of sequence.

However, conventional systems generally are not adapted for automatically forming bends either sequentially or out of sequence, regardless of the size of the workpiece. As a result, conventional systems are significantly restricted in the type of final products they can produce. Moreover, in such systems, it may be difficult or impossible to reverse workpiece motion or reposition the workpiece relative to the bending machinery to achieve out-of-sequence bends after a bend has been formed. An inability to do so can preclude utilizing the bending station to process the workpiece at a location upstream from a previously formed bend. Consequently, it is common to form such configurations by manually maneuvering the workpiece to conduct out-of-sequence processing.

The present inventions address these concerns by providing a method and apparatus for automatically forming sequential or out-of-sequence bends on a workpiece. The inventions can be employed for forming bends of a variety of shapes including corners and smooth, continuous curves. Moreover, the inventions can be employed to operate on a stationary workpiece, where advancement of the workpiece during a bending operation is inconvenient or impossible or on a moving workpiece. Similarly, the bending tools may be stationary or may be moving. The inventions can also be employed in conjunction with a controller for deriving bending information to achieve substantially full automation or to maintain workpiece registration for increased accuracy in bending.

The apparatus of the present inventions include a bending system for bending a workpiece and a positioning system for relative positioning of the workpiece and the bending system so that bends can be formed in various locations within a defined bending region. By virtue of this structure, variable degrees of freedom of motion can be achieved between the bending system and the workpiece such that a series of bends can be formed on the work-piece at various locations within the bending region and in an appropriate sequence to a void interference.

In one embodiment of the invention, known as the single gantry bending machine, the apparatus includes a first and a second bending assembly which are designed to cooperate with one another. The first bending assembly is positioned relative to the second bending assembly via a positioning assembly. The positioning assembly is preferably independently operable to provide relative movement between the first bending assembly and the second bending assembly during a bending operation. Moreover, the first bending assembly can include one or more bending tools or rollers and the second bending assembly includes at least a mandrel and/or a clamp. The positioning assembly positions the bending tool or tools relative to the second assembly to form the desired bend. Relative movement of the workpiece and the bending tools creates the desired bend. A corner or angle of any degree can be formed in the workpiece by clamping the workpiece and then moving a bending roller or other wiping mechanism across the workpiece so that the workpiece is bent about the clamp. A curve can be formed by causing relative movement of the workpiece and a bending element.

In another embodiment of the invention, the apparatus utilizes a central processing module ("CPM") having a stationary tool assembly, a first tool bending assembly, a second tool bending assembly and positioning apparatus for moving the first tool bending assembly and the second tool bending assembly relative to the stationary tool assembly. The positioning assembly is constructed to allow independent movement of both the first and second tool bending assemblies through a wide range of simple and complex motions. The stationary tool assembly may include a pair of rotatable drive rollers, or other known apparatus, for advancing a workpiece to a selected location within an operating region and, preferably, at least one pair of clamp assemblies to securely hold the workpiece and facilitate bending operations. The first and second tool bending assemblies can include multiple bending rollers, and a mandrel or other such metal bending device. Generally speaking, manipulation of a workpiece is performed by the central processing module substantially in the manner described above, in that relative movement is imparted between the workpiece and tool bending assemblies to form the desired bend. The advantage of this bending machine is that there is no need for a gantry, thus further simplifying the manufacture, production and use of the bending machine.

These various bending apparatus can be employed in conjunction with a controller for providing information regarding the bends. The controller receives design information regarding the desired workpiece configuration and derives bending information based on the received design information. The bending information can include information regarding the shapes and positions of bends for forming the desired configuration and/or information regarding a sequence for forming the bends. The derived bend information can be employed by the positioning system of the apparatus to provide substantially fully automatic bending without interference between the workpiece and itself or with the bending tools. In this regard, a robotic arm or similar device also may be incorporated to provide further flexibility in positioning the workpiece. An indexing system may be simultaneously employed to maintain registration of the workpiece relative to the bending tools to maintain full automation and bending accuracy. It should also be readily understood that such equipment is optional and can be utilized with any embodiment of the present invention.

These various bending table apparatus can also be used in conjunction with a preforming system in which stock metal coil is preformed with a base flange, and perhaps a top flange, which are further notched to accommodate intended bends. The stock material may also be subjected to creasing to further facilitate bending and particularized bending instructions can be affixed to the stock material to enhance automation. The stock material may be cut to appropriate lengths consistent with the desired end product or, depending upon the size of the end product, it may be desirable to splice multiple workpieces together, rather than work with a single, cumbersome workpiece.

According to another aspect of the present invention, a method for forming out of sequence bends in a workpiece is provided. The method includes the steps of determining a sequence of bends for forming a workpiece into a desired design, positioning the workpiece in a bending region, providing a bending tool which is positionable relative to the bending region by operating a positioning system, forming a first bend by operating the positioning mechanism to position a bending tool at a first location of the bending region, forming a second bend by operating the positioning mechanism to position the bending tool at a second location of the bending region, and holding at least a portion of the workpiece fixed from a first time of forming the first bend to a second time of forming the second bend.

Further, the positioning system can be operated to form a series of bends out of sequence. For example, for a series of three bends, including a first bend, a second bend and a third bend, where the second bend is physically located between the first and third bends, the positioning system can be operated to form the second bend at a time which is not chronologically between the times when the first and third bends are formed. The method of the present invention allows for formation of the bends in a sequence which reduces or eliminates mechanical interference. Such a sequence can be determined by employing a controller which is capable of determining an optimal series for the bends.

The invention also includes a method for operating a bending machine for bending a workpiece to form a desired design, whereby a process for assuring conformity to selected design criteria is greatly simplified. The method includes the steps of determining a completed shape of a desired design that includes a plurality of bends, selecting design criteria concerning the process for bending the workpiece to form the desired design, analyzing a potential operation for straightening one of the bends of the design relative to the selected design criteria, repeating the step of analyzing to derive a backwards sequence for forming a straightened workpiece beginning from the desired final design, reversing the backwards sequence thereby to obtain a forward sequence for forming the workpiece into the desired design in accordance with the design criteria, and operating the bending machine to form the bends in the workpiece in the forward sequence. The bending criteria may involve avoiding mechanical interference between separate portions of the workpiece, maintaining the workpiece within a defined bending region of the bending machine, advancing the workpiece through a specific location of the bending machine (e.g., a clamp or advancement rollers), minimum time and/or power for completing the bends or other desired criteria.

Upon a review of the following detailed description and drawings, it will be readily apparent to those having skill in the art, that the inventions herein have a broad range of applications beyond the sign industry, including but not limited to forming glass tubing, or forming enclosures. The present inventions are capable of any application requiring precise movement and positioning of tools, including lasers, routers, cutters, welders, printers and the like.

BRIEF DESCRIPTION OF THE DRAWINGS

For a more complete understanding of the present invention and further advantages thereof, reference is now made to the following detailed description, taken in conjunction with the drawings in which.

It should be understood that the drawings are not necessarily to scale. In certain instances, details which are necessary for an understanding of the present invention or which render other details difficult to perceive may have been omitted. It should be also understood, of course, that the invention is not necessarily limited to the particular embodiments illustrated herein.

DETAILED DESCRIPTION

The present invention is directed to a method and apparatus for bending a workpiece to form a desired shape and is useful in a variety of bending applications involving various materials and profile types. In the following description, the invention is set forth with respect to three specific applications for bending sheet metal to form a side panel of a three dimensional housing. Such housings are common in the sign industry for use in constructing neon lighted channel letters or other designs.

Figure 1:
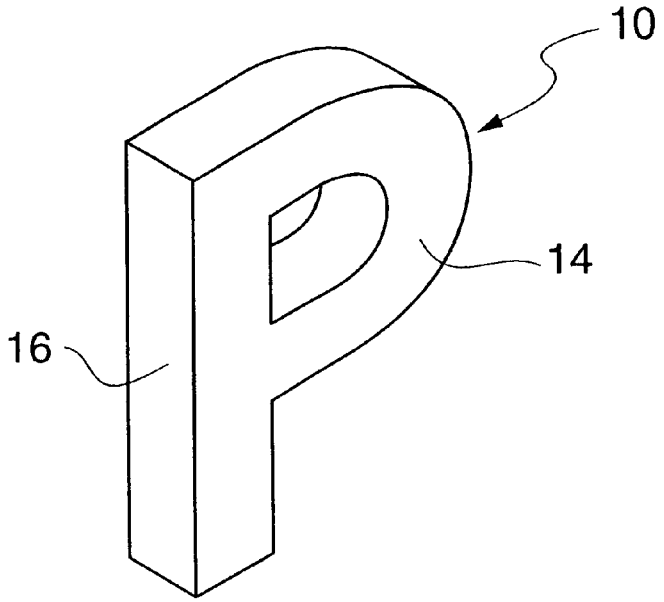
FIG. 1 is a perspective view of a channel letter constructed in accordance with the present invention.
Figure 2:
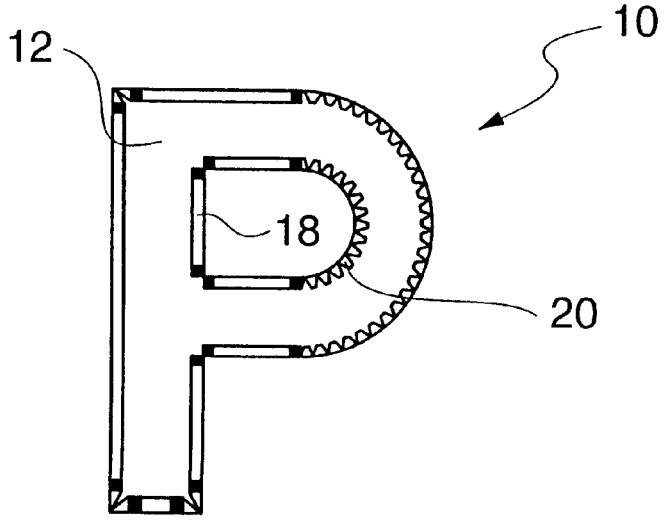
FIG. 2 is a bottom plan view of the channel letter of FIG. 1.
Figures 3A, 3B:
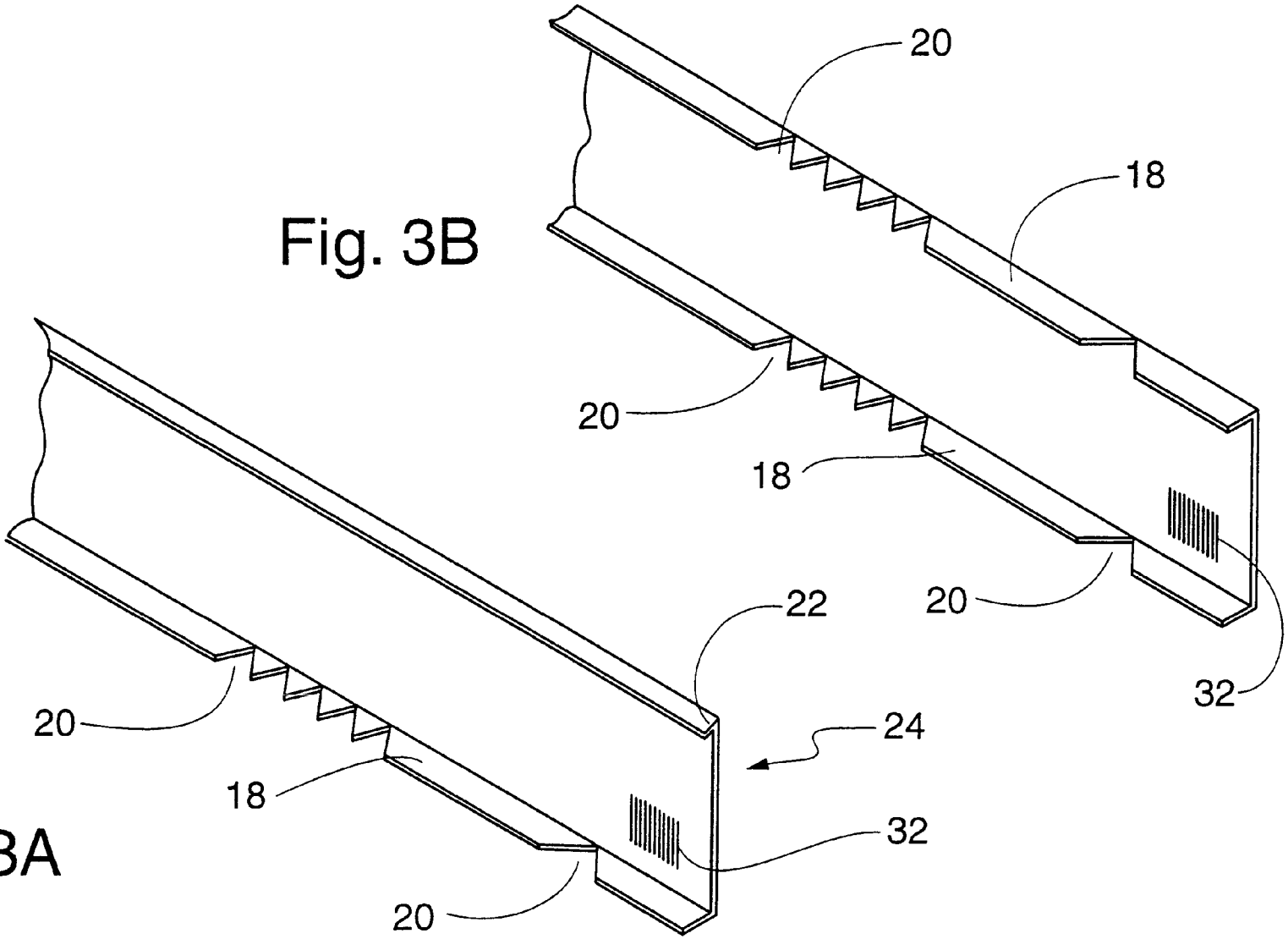
FIG. 3A is a perspective view of a portion of a preformed workpiece used to form the channel of the channel letter of FIG. 1.
FIG. 3B is a perspective view of a portion of a different preformed workpiece used to form an enclosure.

A channel letter 10 constructed in accordance with the present invention is shown in FIGS. 1 and 2. Generally, the channel letter 10 includes a flat letter-shaped back plate 12, a translucent or transparent front plate 14, and a side panel or channel 16. The channel 16 includes a flange 18 for interconnection to the back plate 12 using pins, rivets or the like. The flange 18 may have notches 20 to facilitate bending. A hem 22 (FIG. 3A) may also be formed on the channel 16 for use in attachment of the front plate 14. Alternatively, as seen in FIG. 3B, a second flange 18 may be formed on the opposite edge of the workpiece, and would include notches 20 matching those formed in the opposite flange 18.

A workpiece 24 that can be used in accordance with the present invention to form the channel 16 is shown in FIG. 3. The processes and apparatus for pre-forming the channel 16 are set forth in related U.S. Pat. Nos. 5,377,516 and 5,456,099 which are hereby incorporated by reference. As shown, the pre-formed channel 16 includes a flange 18 and a hem 22.

The illustrated bending machines 30 are scalable in size to work with a large range of workpieces, in both size and material type. The preferred embodiments, intended for use in connection with neon signs, are designed to operate on aluminum, copper-based, stainless steel or steel workpieces. The typical thickness of the workpiece 24, used in connection with neon signs, will vary from about 0.4 millimeters to about 3 millimeters depending on the material and the application. The typical width of the workpiece 24 will vary from about 5 centimeters to about 30 centimeters, although other material thicknesses and widths can be accommodated with appropriate modifications to the machinery.

The bending machines of the present invention may be integrated or implemented in line with the pre-forming tools described in the above-referenced related applications, or may be separate. The illustrated workpiece 24 includes encoded or machine-readable indicia 32, such as a bar code, which can be used for inventory purposes and/or to access a file of bending information setting forth, for example, the shape, size, sequence of bends and other information for use in bending the workpiece 24 to form the desired design.

A. The Input Processing Module

Figure 4:
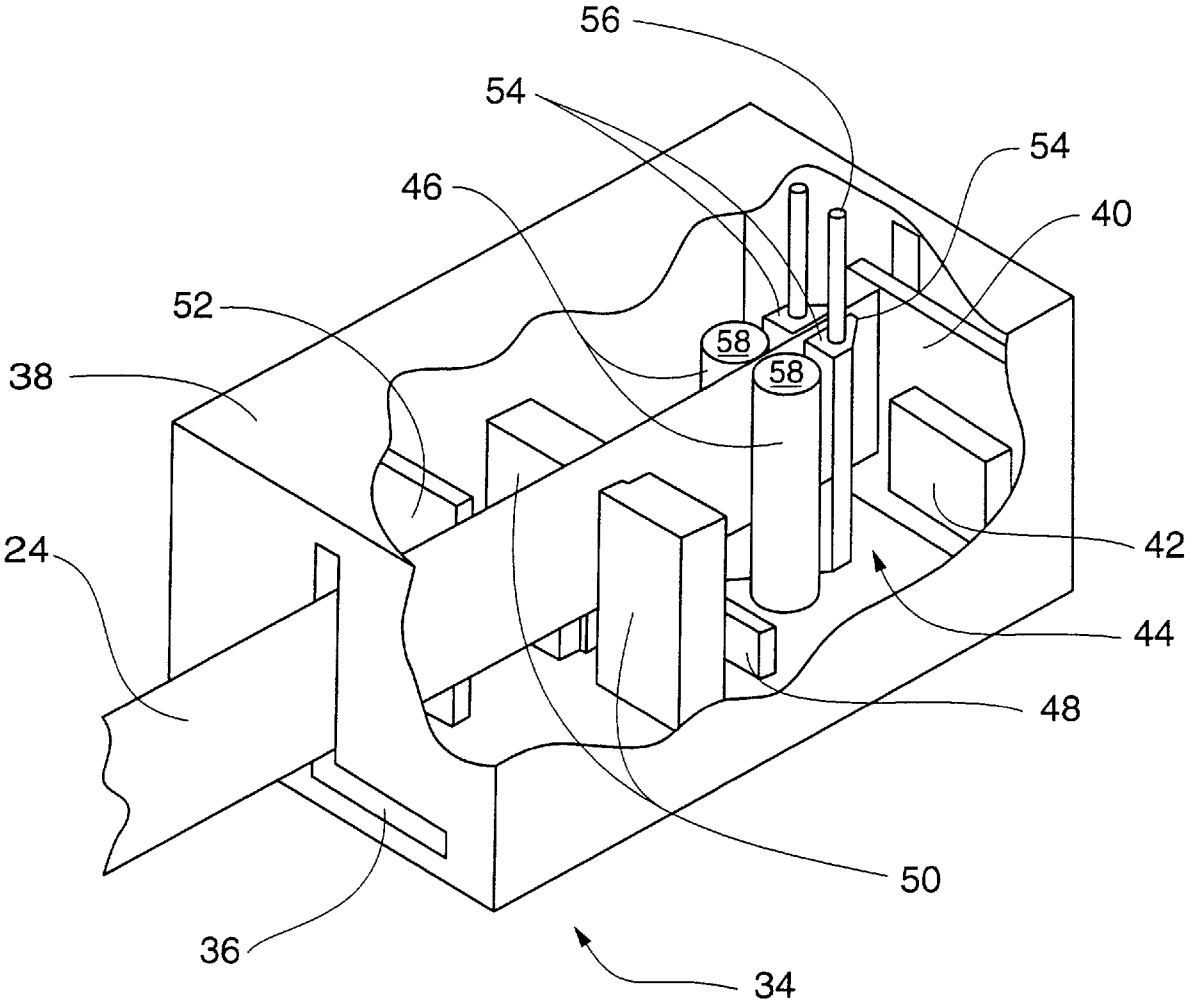
FIG. 4 is a perspective view, partially cut away, of one embodiment of the input processing module of the present invention.
Figure 5:
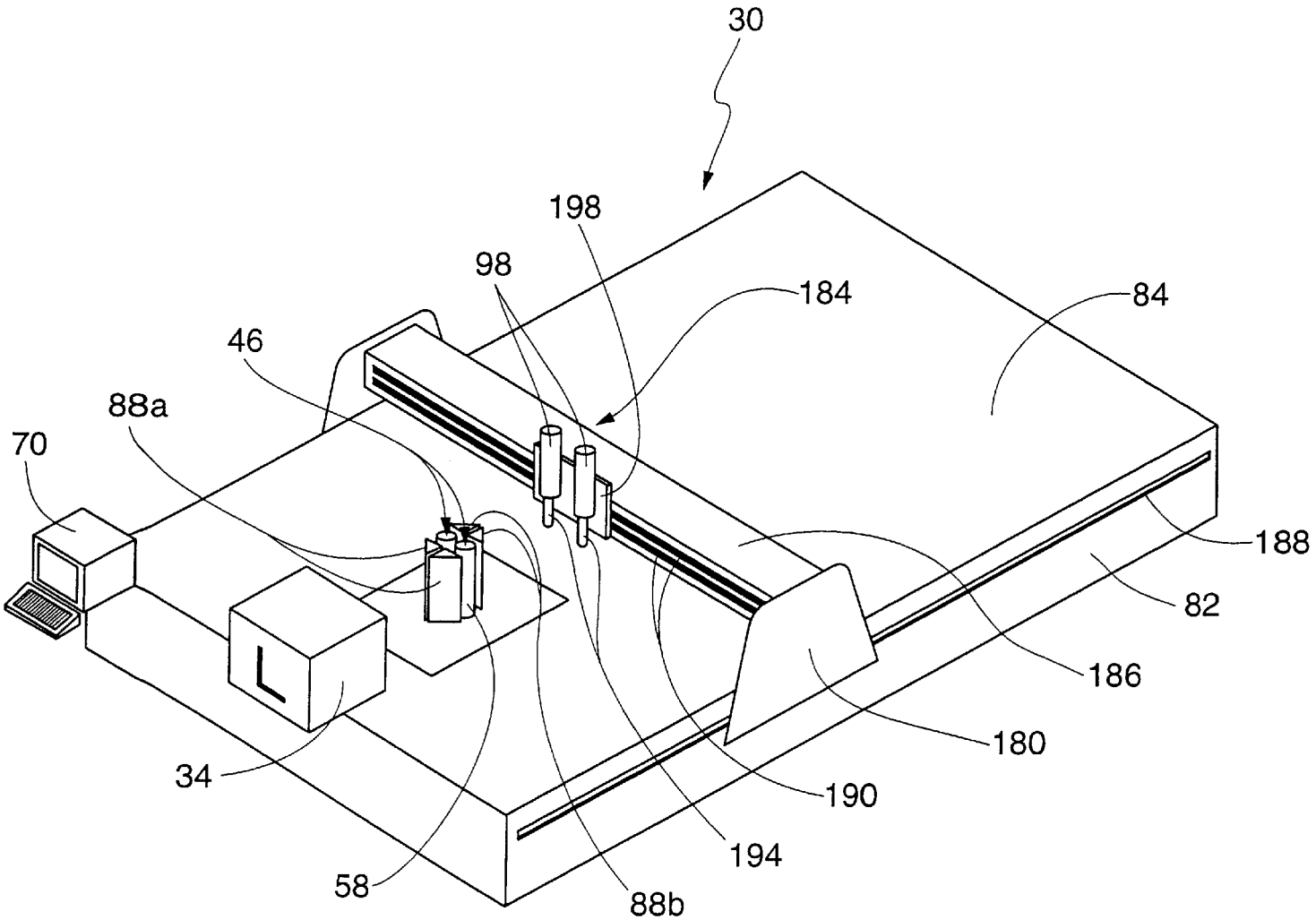
FIG. 5 is a perspective view of the single gantry bending machine embodiment of the present invention.
Figure 7:
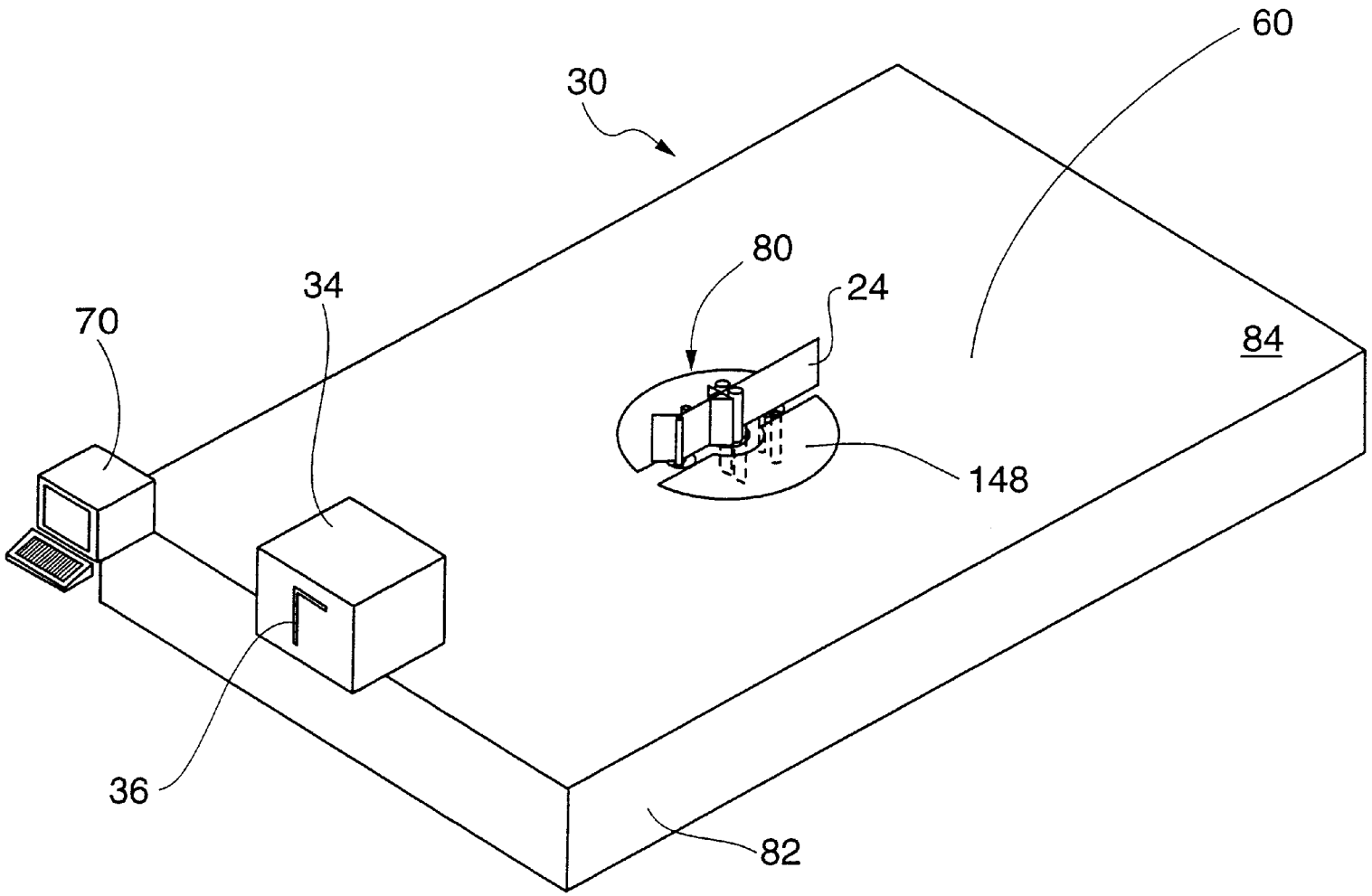
FIG. 7 is a perspective view of the central processing module bending machine embodiment of the present invention.

Referring to FIGS. 5 and 7, various embodiments of the bending machines of the present invention are generally identified by the referenced numeral 30. Generally, all of the bending machines incorporate an input processing module (IPM) 34 in one form or another. One embodiment of the IPM is shown in greater detail in FIG. 4.

The function of the IPM 34 varies depending upon the capabilities of the bending machine 30. For example, the IPM 34 may include precreasers or notching devices to facilitate ultimate bending of the workpiece, cutting devices to cut the stock material to desired lengths, offset dies to form offsets in the workpiece for fastening end portions together, and indexing or registering systems to accurately identify the location of the workpiece relative to the bending tools for generating precise and accurate bends. In connection with a central processing module bending machine, the function of workpiece position registration and indexing is preferably incorporated directly into the stationary tool assembly, although this function and the other identified functions may be utilized within an IPM 34 or as a separate device. The IPM 34 is shown as a separate component in FIG. 4 and, for example, could include a precreaser, clamps, notching devices and offset dies, other appropriate preforming equipment or any combination thereof.

The IPM 34 will be described herein as associated with a gantry type bending table. Alternative embodiments and other variations or configurations deemed to be within the scope of Applicants' inventions will be understood to persons of skill in the art.

With reference to FIG. 5, the IPM 34 extends a small distance into the gantry type bending table working area, in the illustrated embodiments approximately six inches. For ease of construction and assembly, the IPM 34 may be constructed and transported separate from the bending machine 30 and then assembled on-site. In this regard, indexing pins or the like (not shown) may be provided to insure accurate registration.

In FIG. 4, the initial insertion of the workpiece 24 into the IPM 34 may be manual or it can also have an automatic input feed from a coil of stock material or a preformer apparatus (not shown). In this regard, the workpiece 24 is introduced into the IPM 34 through a conformal slot 36 formed in the housing 38 of the IPM 34. The conformed slot 36 may be modified and oriented in any fashion to accommodate workpieces 24 of varying cross sections. The workpiece 24 is progressively inserted through the conformal slot 36 until an end of the workpiece 24 reaches a stop 40. The stop 40 insures appropriate longitudinal positioning of the workpiece 24. In addition, the stop 40 is equipped with a sensor 42 which confirms correct loading of the workpiece and triggers various functions as will be set forth below. The sensor 42 may be, for example, an optical or electrical contact sensor, an inductive or magnetic sensor, or any other suitable sensor element.

The illustrated IPM 34 in FIG. 4 includes a clamping device 44, an advancement assembly 46, a sensor or scanner 48, a die assembly 50 and shears 52. The clamping device 44 includes a pair of jaw members 54 mounted to pivot on shafts 56 between open and closed positions to selectively disengage and engage the workpiece 24. The advancement assembly 46 includes at least a pair of motor-driven rollers 58 that engage the workpiece 24 so as to advance the workpiece 24 into the working area 60 of the bending machine 30 as will be described in more detail below. The rollers 58 can be of varying sizes, although a diameter of approximately two inches appears most suitable for the stock material involved here. The external surface of the roller may be urethane, rubber, or other material suitable for securely manipulating the workpiece without slippage. The rollers 58 are also laterally adjustable to accommodate loading of a workpiece 24 and workpieces of varying thickness. The sensor or scanner 48 is positioned to read the machine readable indicia 32 (FIG. 3) on the workpiece 24 and may be inductive, magnetic, optical or other type of sensing apparatus. This information is then reported to the controller 70. A die assembly 50 is optionally used to form offset flanges in the workpiece for joining separate ends thereby resulting in a smooth walled final product. A further optional piece of equipment is a scribe (not shown) to form creases across the workpiece 24 at predetermined bending locations (i.e., at the notches 20 in the flange 18) to facilitate bending and improve longitudinal bending location accuracy. The shears 52 are used to cut the workpiece 24 to a desired length when the workpiece 24 is provided from a coil or the like or when bending is facilitated by utilizing smaller workpieces.

When the sensor 42 senses that the workpiece 24 has contacted the stop 40, the resulting signal triggers the clamping device 44 to engage the workpiece 24. The advancement assembly 46 may or may not have advanced the workpiece 24 against the stop 40. If not, the advancement assembly 46 engages the workpiece 24. Additional rollers or guides may also engage the workpiece 24 at this time in order to ensure proper vertical and longitudinal alignment. The sensor 42 also serves to signal the controller 62 thereby enabling the "start" command for workpiece 24 processing to begin, in a totally automated environment. If an indexing system is employed, a known point of reference or origin is defined to allow calculation of all subsequent workpiece positions. The origin may be in close proximity to the optical scanner 48, or may be any other known point such as the forward tip of the clamping drive 44.

In summary, the IPM 34 is capable of performing the following operations. The conformal input slot 36 allows the bending machine 30 to accept material that is correctly flanged. The stop 40 and sensor 42 indicate correct and complete engagement of the workpiece 24 into the bending machine 30. The sensor 42 confirms correct loading of the workpiece 24 and triggers engagement of the clamping device 44 and advancement assembly 46, as well as triggering the software to initiate processing. In addition, the clamping device 44 clamps and releases the workpiece 24 as required for processing and may also define a home position or origin for calibrating all mechanical tooling positions and moves. This origin may be coincident with the edge position of the workpiece 24 upon successful loading or a scanable indicia printed on the workpiece 24. The advancement assembly 46 is operable to move the workpiece 24 through the clamping device 44 and control the rate of movement including acceleration, deceleration, feed speed and secure stopping. In this regard, the illustrated bending machines 30allow for feed speeds up to 7.6 meters per minute. The optional scribe is capable of forming a vertical crease across the workpiece 24 width (the workpiece 24 being inserted edgewise, flange up or down or in some other orientation depending upon the orientation of the bending table) and is adjustable to accommodate various material thicknesses in response to software inputs. The optical scanner 48 reads the indicia 32 for inventory and workpiece processing purposes. Finally, the shears 52 are operable to cut the workpiece 24 to length when required.

It should be further understood that all of the embodiments of the present invention are capable of forming final designs of vastly varying sizes and shapes. Accordingly, while it is contemplated that a complete design will be fashioned from a single workpiece, it is also contemplated that a final design may be assembled from multiple workpieces which comprise a portion of the final design. Such circumstances include final designs which are physically large in size or which have an overall complex shape.

The following is a detailed description of three embodiments of the bending machine of the present invention. These embodiments are intended to be illustrative of Applicants' inventions, rather than a limitation on the manner of practicing the inventions. For simplicity of understanding, Applicants have endeavored to use the same reference numerals with respect to common elements found in each of the embodiments.

B. The Central Processing Module Bending Machine

With reference to FIGS. 7–13, the fundamental components of the central processing module 80 are disclosed. In general, the central processing module 80 is located in a table 82 which has a work surface 84 and defines a work area 60. The CPM 80 allows for complete manipulation and bending of a workpiece into a desired final shape within a defined work space 60 and without interference among the bending tools and other componentry of the bending machine 30. While the central processing module 80 is necessarily complex in order to automatically accomplish the formation of a range of simple to complex designs, it represents a refined implementation of Applicants' inventions.

The central processing module 80 generally includes a pair of identical tool bending assemblies 86*a*, 86*b*, dual pairs of opposed jaw members 88*a*, 88*b*, and an advancement assembly 46. The advancement assembly illustrated is a pair of drive rollers 58. Other acceptable methods of advancing the workpiece 24 include robotic arms, tractor feeds and escapement mechanisms. One or both of the opposed jaw members 88*a*, 88*b* hold the workpiece 24 while the bending tool assemblies 86*a*, 86*b* effectuate the desired bending in response to instructions from the controller 70. Alternatively, the advancement assembly 46 may move the workpiece 24 relative to the tool bending assemblies 86*a*, 86*b*, or both the tool bending assemblies and workpiece may move, in response to instructions from controller 70. The workpiece 24 may either advance or retreat through the drive rollers 58 of the advancement assembly 46. The position of the workpiece 24 relative to the drive rollers 58, work surface 84, the jaws 88*a*, 88*b* and the bending tool assemblies 86*a*, 86*b* is indexed and always known relative to a defined origin. The indexing apparatus, whether implemented optically or through some other registration means, may be associated with the drive rollers 58, the jaws 88*a*, 88*b* or positioned in an IPM 34, as previously discussed.

Figure 12:
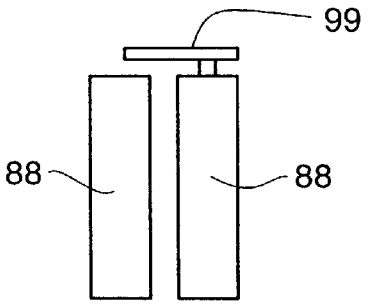
FIG. 12 is an elevational end view of the clamping device of FIG. 8 taken along line 12—12.

With reference to FIG. 12, one of the drive rollers 58 and/or one of each pair of jaws 88 may include an upper extension or hat 99, of a larger diameter or size which functions as an upper restraint to preclude the workpiece 24 from moving out of engagement.

For interference reasons, both pairs of opposed jaws 88*a*, 88*b*, the drive rollers 58 and the bending tool assemblies 86*a*, 86*b* are fully retractable beneath the plane of the work surface 84. As the workpiece 24 is bent and manipulated, various of these components can be retracted to avoid interference with the workpiece 24. Upon completion of all bending operations, all of these components are retracted to allow easy removal of the workpiece 24 from the top of the table 82. In addition, while not shown in the accompanying illustrations, a robotic arm, operating in response to instructions from the controller 70, may also move the workpiece in order to obtain necessary positioning for desired bending.

Figure 9:
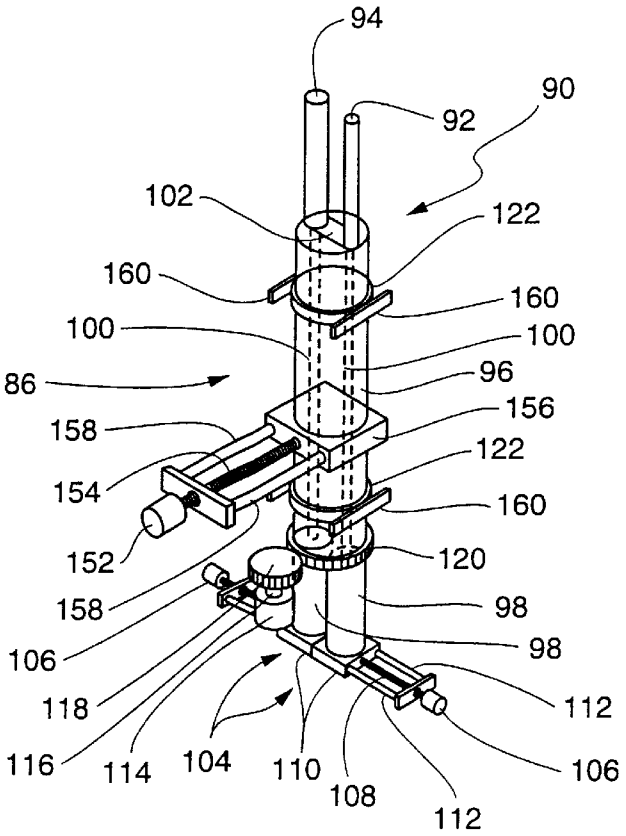
FIG. 9 is a perspective view of one bending tool assembly of the central processing module.

For purposes of illustration, a single tool bending assembly 86 is shown in FIG. 9. In the preferred embodiment, the tool bending assemblies 86*a*, 86*b* are identical. However, it is contemplated that they can be configured differently. At the upper or operative end 90 of the tool bending assemblies 86*a*, 86*b* are a pair of bending tools 92, 94. One bending tool is a small radius roller 92 and the other is a large radius roller 94. Each set of bending tools 92, 94, in combination with a complementary set of jaws 88 from the advancement assembly 46, form the desired bend in the workpiece 24. In the illustrated embodiment, the large radius roller 94 has a diameter of 1.15 inches and the small radius roller 92 has a diameter of 0.875 inches. Both rollers have a height of 13 inches when fully extended above the work surface 84.

The bending tool assemblies 86*a*, 86*b*, including the small radius and large radius bending tools 92, 94, have an intricate range of motion. Both the small and large radius bending tools 92, 94 retract from the work surface 84 into the tool bending assembly casing 96 by means of vertical actuators 98. The bending tools 92, 94 are positionable anywhere between a fully retracted position within the casing 96 or fully extended position above the work surface 84. Both bending tools 92, 94 freely rotate about their shafts 100, which shafts 100 also extend and retract under the impetus of the vertical actuators 98 to move the bending tools 92, 94 in and out of the casing 96. The vertical actuators 98 are hydraulic, but could be pneumatic, electric or any other type known to a person of skill in the art.

Figure 11:
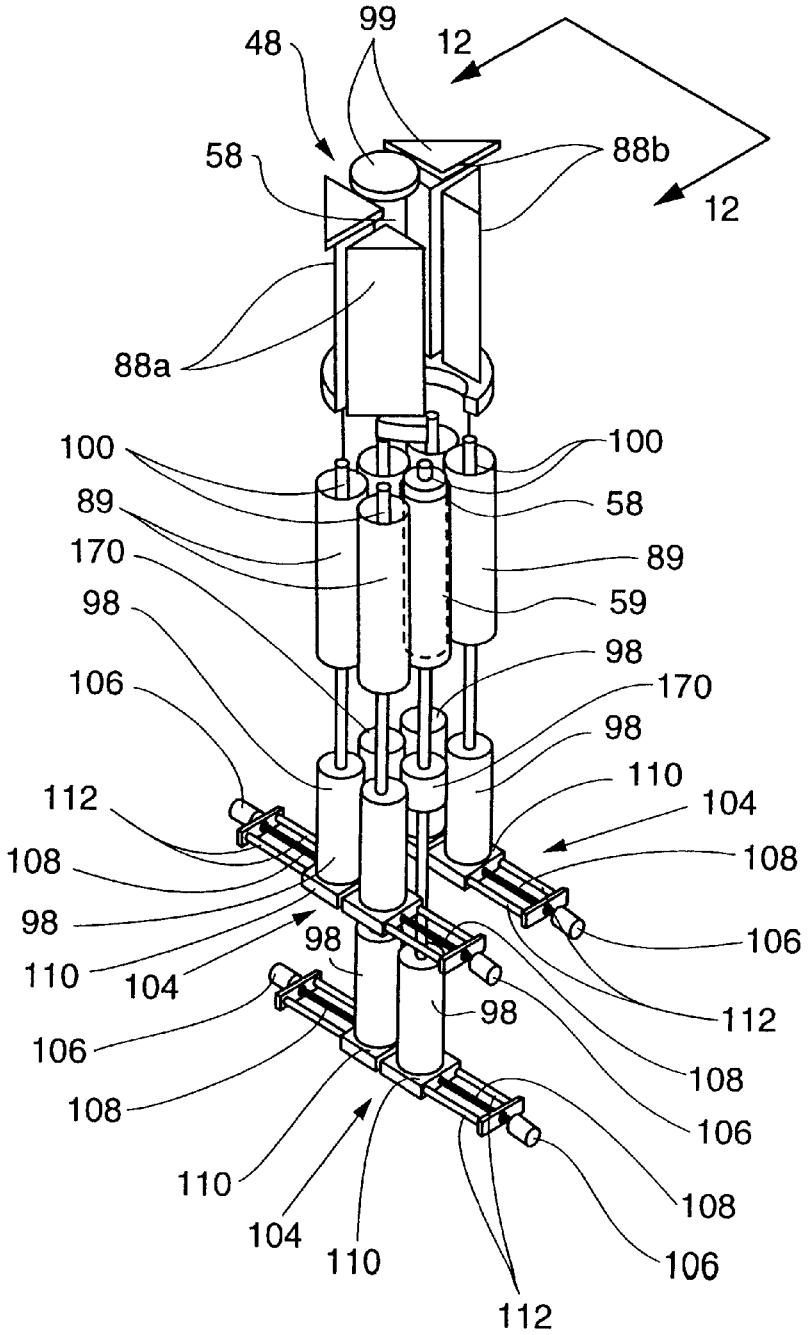
FIG. 11 is a perspective view of advancement assembly of the central processing module.

As seen most clearly in FIG. 11, either of the bending tools 92, 94 may be provided with an upper portion or hat 99 of a larger diameter which functions as an upper restraint to preclude the workpiece 24 from moving out from between the bending tools 92, 94.

Figure 8:
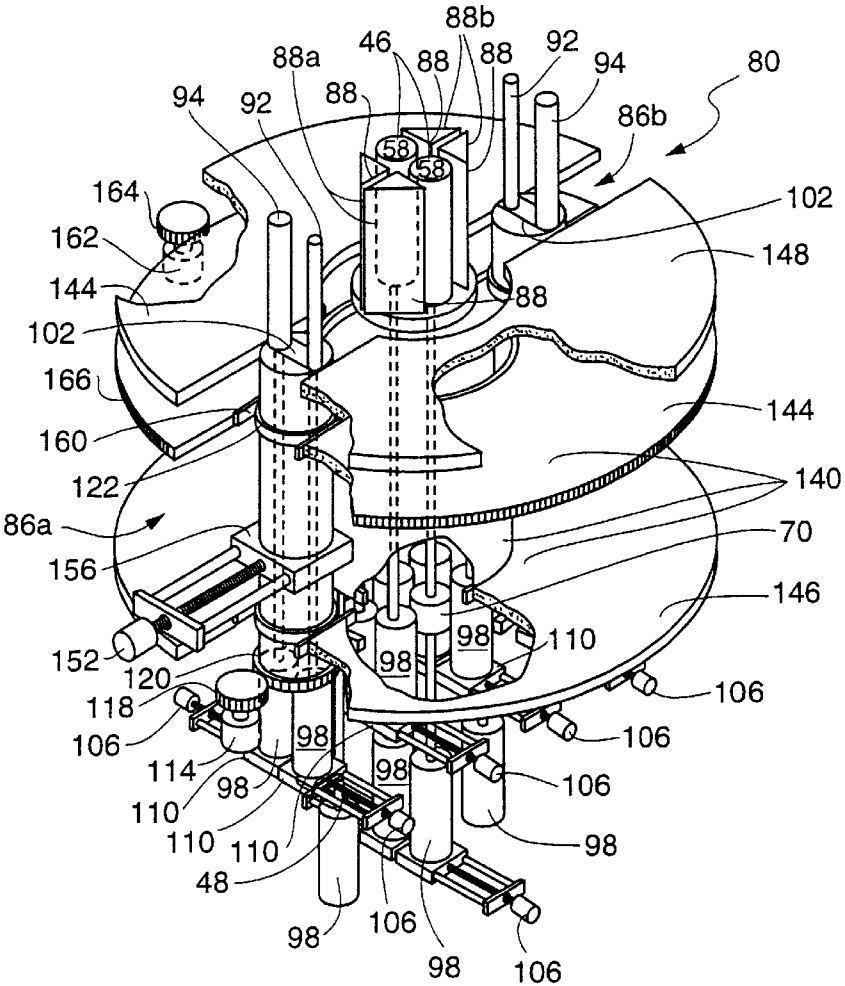
FIG. 8 is an exploded partial perspective view of the central processing module of FIG. 7.

As seen in FIGS. 8 and 9, the large and small radius bending tools 92, 94 can also move linearly towards and a way from each other along the defined pathway 102 of the bending tool assembly casing 96. This lateral movement is effectuated by a pair of lateral actuators 104. Each lateral actuator 104 is provided with a drive motor 106 which drives a ball screw 108 to move the lateral actuator blocks 110 along guide posts 112. Because each vertical actuator 98 is mounted to a lateral actuator 104, the bending tools 92, 94 have at least two dimensions of movement.

The bending tool assembly casing 96 is rotatable to effectuate simultaneous rotation of the large and small bending tool rollers 92, 94. Rotation of the bending tool assembly casing 96 occurs through the action of hydraulic motor 114 driving shaft 116 to rotate drive gear 118 which, in turn, rotates the tool assembly driving gear 120. This causes the casing to rotate within an upper and lower tool assembly bearings 122.

Figure 13:
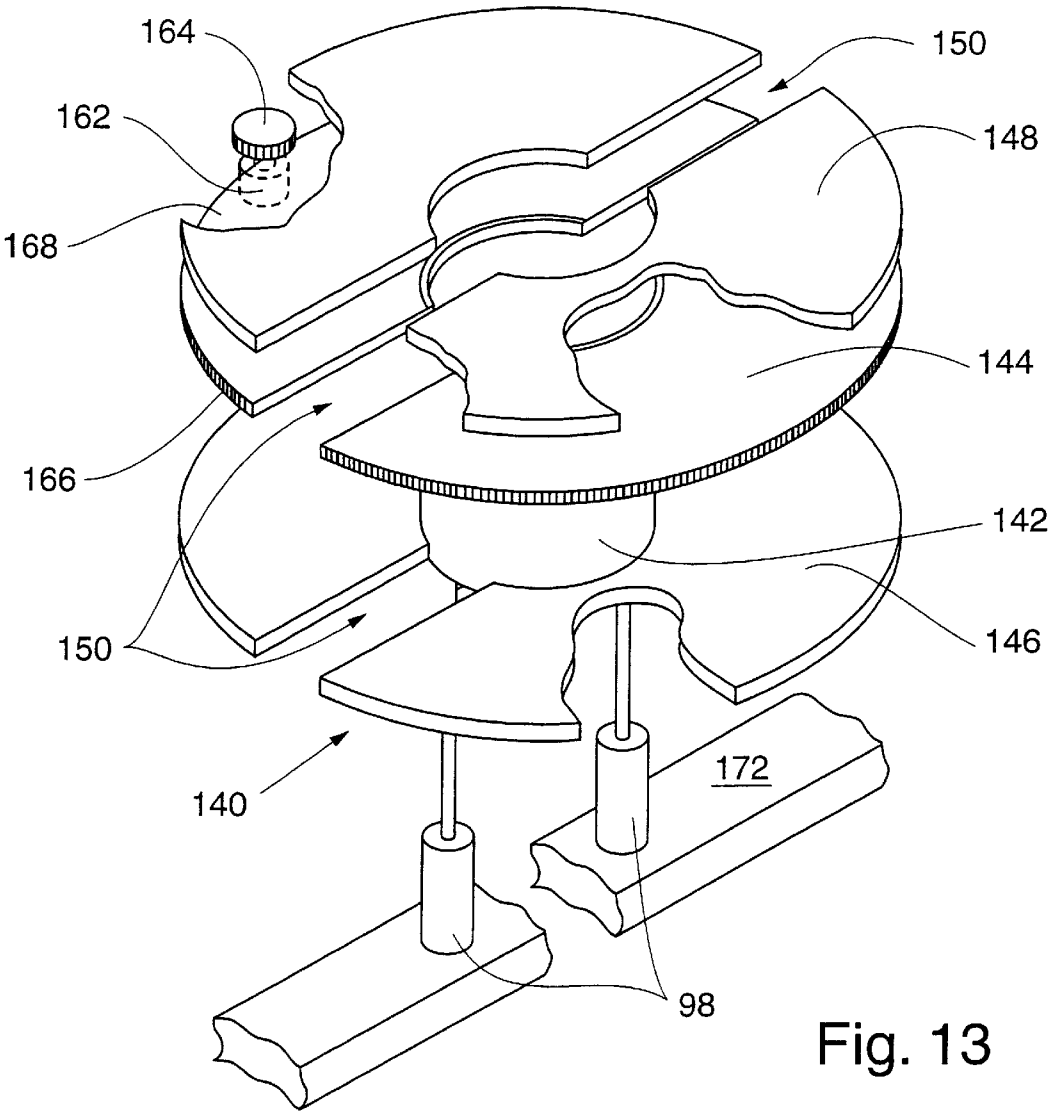
FIG. 13 is a perspective view, partially cut away, of the spool assembly of the control processing module.

As seen in FIGS. 8 and 13, the entire tool bending assembly is positioned in a spool assembly 140. The spool assembly 140 is positioned beneath the work surface 84 of the table 82. The spool assembly 140 includes a hollow cylindrical central section 142 and upper and lower flanges 144, 146, respectively. A rotating plane 148 is positioned above the upper flange 144 and is co-planar with the work surface 84. Each tool bending assembly 88 moves laterally within aligned complementary guide slots 150 formed in the upper and lower flanges 144, 146 and the rotating plane 148. Movement of the tool bending assembly casing 96 within the guide slots 150 is accomplished by an actuator motor 152 which drives a ball screw 154 to move the actuator block 156 along guide posts 158. As seen in FIG. 9, the bearing assemblies 122 are provided with a pair of lateral flanges 160 which extend outwardly from the bearing 122, and slide in a receptive groove (not shown) formed in the wall of the guide slots 150. This interconnection provides the individual bending tools with necessary leverage and stability to bend the workpiece 24 as needed.

The spool assembly 140 is subject to rotation by hydraulic motor 162 which rotates driving gear 164 to drive complementary driven gear 166 formed on the outer perimeter 168 of the top spool flange 144. The motor may be of any type sufficient to achieve the desired movement. Rotation of the spool assembly 140 causes the tool bending assemblies 86*a*, 86*b* to rotate or orbit in unison about the jaws 88*a*, 88*b* and advancement assembly 46. In the preferred embodiment, the spool assembly 140 is approximately three feet in diameter but can be sealed, together with the other components, to satisfy any application.

Turning to FIG. 11, the structure of the jaws 88 and advancement assembly 46 is depicted. Each of the jaws 88 and rollers 58 may be retracted beneath or extended above the work surface 84 by a vertical actuator 98 associated with each element. The vertical actuators 98 are interconnected to the jaws 88 and rollers 58 by the shafts 100. Each of the jaws 88 and drive rollers 58 move towards and away from each other in order to engage and disengage the workpiece 24. Lateral actuators 104 accomplish this movement. The vertical actuators 98 are mounted on lateral actuator blocks 110. Motors 106 rotate ball screws 108 to thereby move the lateral actuator blocks 110 along the guide posts 112. Motors 170 impart rotation to the drive rollers 58 through shafts 100.

As also seen in FIG. 11, the rollers 58 and jaws 88 retract into receiver containers 59 and 89, respectively. The receiver containers 59, 89 are axially aligned with the actuators 98. The rollers 58 and jaws 88 may be fully retracted into the receiver containers 59, 89, fully extended above the work surface 84, or disposed at any position inbetween.

As seen in FIGS. 8 and 13, the entire spool assembly 140, including the tool bending assemblies 86*a*, 86*b* and advancement assembly 46 is vertically adjustable through yet another pair of vertical actuators 98. These vertical actuators provide the only connection of the CPM 80 to the frame 172 of the bending machine 30. In this manner, the entire spool assembly can be uniformly positioned with respect to the work surface 84. In turn, the bending tools 92, 94, the jaws 88 and the drive rollers 58 can be uniformly positioned to meet variable height requirements and thereby accommodate different sized workpieces.

It should be appreciated that a controller 70 and operational software coordinates and moves the componentry through all the variable degrees of motion in order to accomplish the desired bending operations. The operation of the controller 70 is described in greater detail below.

Figure 10:
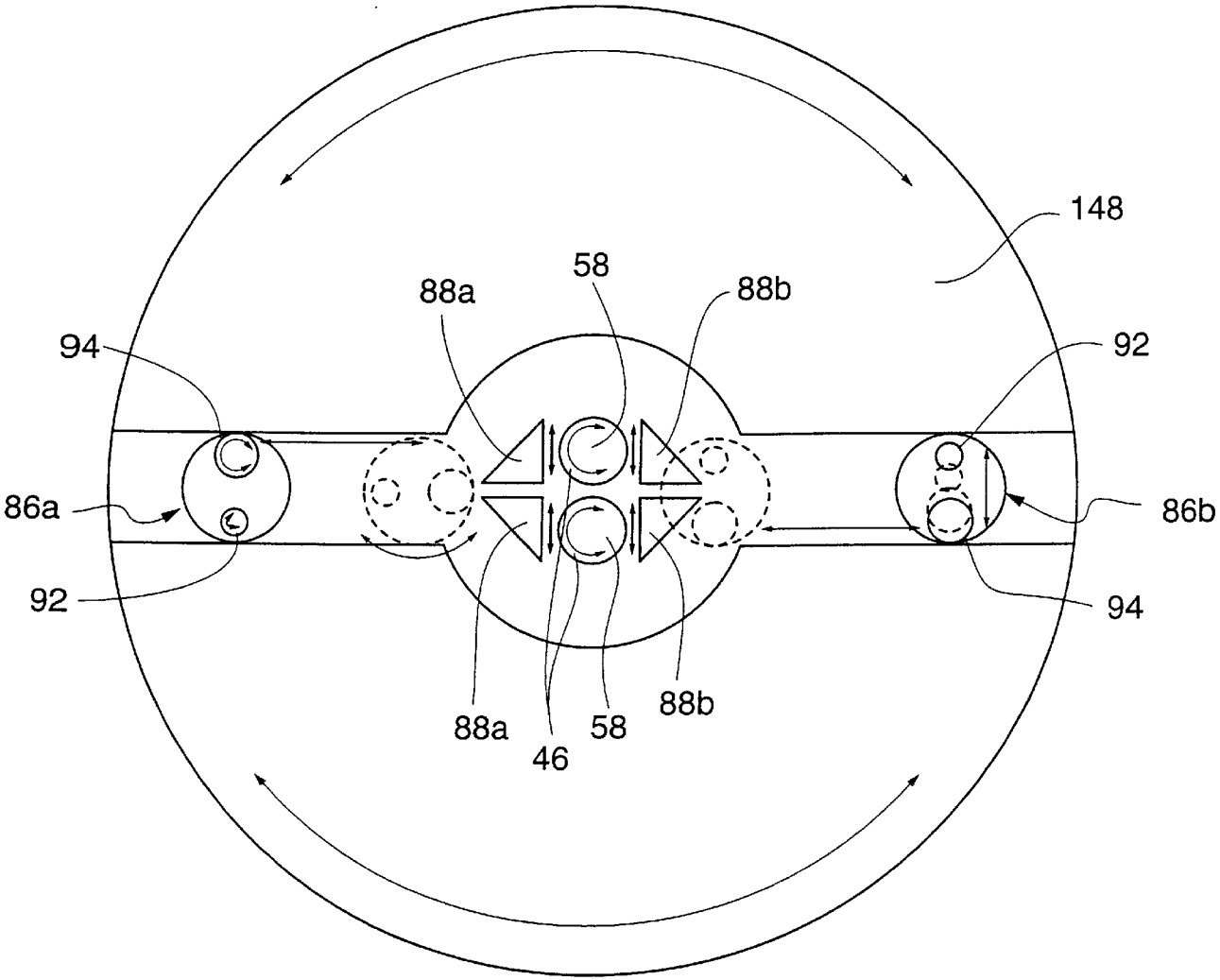
FIG. 10 is a top plan view of the central processing module bending machine.

With reference to FIG. 10, the varied and relative movement of the bending tools 92, 94 relative to the centrally located jaws 88 can be explained. It will readily be appreciated that the degrees of freedom of motion are numerous and complex, allowing the CPM 80 to form virtually any combination of any type of bend. First, and in no particular order, the bending tools 92, 94 move linearly toward and away from each other. Second, the tool bending assembly 86 may move linearly within the guide slots 150 toward and away from the jaws 88*a*, 88*b*. During this linear movement of the tool bending assemblies 86, the bending tools 92, 94 may be stationary or moving relative to each other, as well as stationary or rotating about the respective axes of shafts 100. Third, the tool bending assembly casings 96 may rotate within tool assembly bearings 122. Thus, the bending tools 92, 94 may have orbital motion relative to each other. Finally, the tool bending assembly casings 96 may orbit about the jaws 88 by rotational movement of the spool assembly 140. As a result of all of the various combinations of degrees of freedom of motion, the relative movement between the bending tools and the workpiece may be pure linear, relative linear, pure rotational, relative rotational, pure orbital, relative orbital, sinusoidal, epicyclic (i.e., a combination of movement along an arc, such as rotational and orbital), compound epicyclic (i.e., an epicycle motion in combination with a different epicyclic motion) or any combination of the foregoing.

Figure 14A:
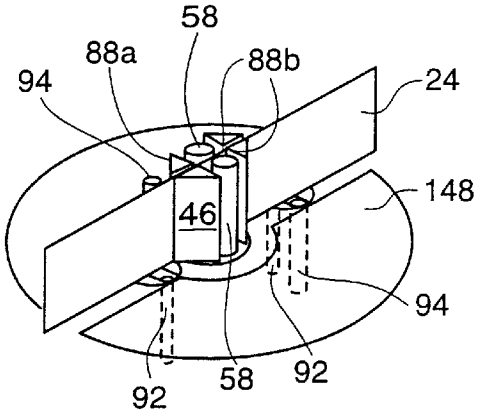
FIGS. 14A–C are partial perspective views of the central processing module showing the formation of a smooth curve.
Figure 14B:
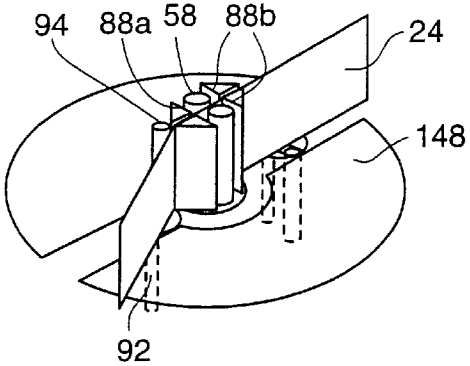
Figure 14C:
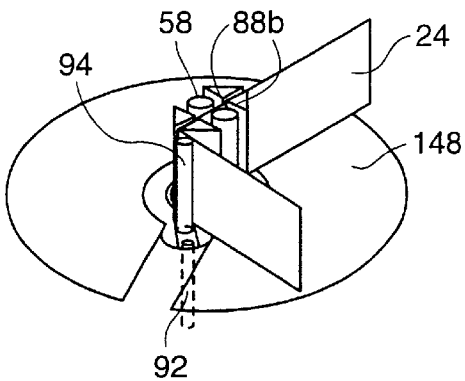
Figure 14D:
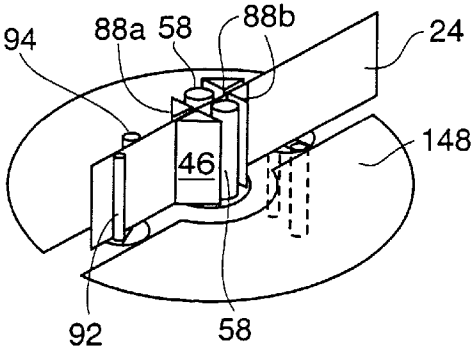
FIGS. 14D–F are partial perspective views of the central processing module showing the formation of a corner bend.
Figure 14E:
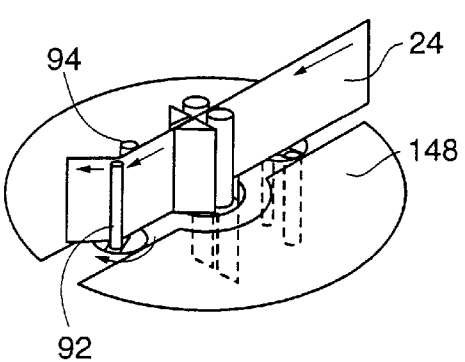
Figure 14F:
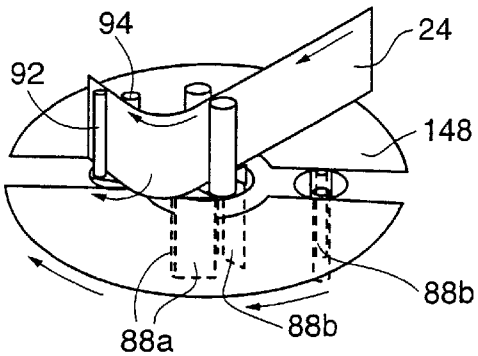

With reference to FIGS. 14A–F, two examples of the central processing module will be described and illustrated. FIGS. 14A–C are representative sequences of the generation of a precise angle or corner. FIGS. 14D–F are representative sequences of the generation of a smooth curve.

FIGS. 14A–C illustrate a corner of 90° being made in the workpiece 24. FIG. 14A shows a workpiece 24 held in place by opposed jaws 88. Drive rollers 58 move the workpiece 24 into position for formation of the desired bend. Jaws 88 clamp the workpiece 24 at an indexed location to generate the bend in the appropriate location in the workpiece 24. As described above, alignment of the workpiece 24 relative to the jaws 88 can be accomplished in numerous ways.

With reference to FIG. 14A, the second bending tool assembly 86 has retracted beneath the work surface 84 of the table 82. Once the workpiece 24 is clamped in place, the drive rollers 58 disengage the workpiece 24. The second pair of opposed jaws 88 do not engage the workpiece 24 and may be left in place or may be retracted beneath the work surface 84. Large radius bending tool 94 is then positioned on one side of the workpiece 24 while its complementary small radius bending tool 92 is retracted beneath the work surface 84 of the table 82 to avoid interference with the workpiece 24. As seen in FIG. 14B, bending tool assembly casing 96 is then rotated within tool assembly bearing 122 by motor 114 to rotate large radius bending tool 94 into contact with the workpiece 24 directly adjacent the forward end of opposed jaws 88. As seen in FIG. 14C, spool assembly 140 is then rotated to cause the bending tool assembly casing 96, together with the large radius bending tool 94, to wipe across the apex of the opposed jaws 88 to create the 90° bend in the workpiece 24. Because the spool assembly 140 has moved relative to the workpiece 24, it is necessary for the second bending tool assembly 86 to retract to avoid interference with the workpiece 24.

As previously shown, the bending tool assembly 86 will also simultaneously rotate as needed to effectuate the desired bend. Having formed a 90° bend, the bending tool assembly 86 may be repositioned to form a second desired bend in the workpiece 24, upstream of the previously formed 90° bend. Alternatively, the second bending tool assembly 86 may form a desired bend downstream of the previously formed 90° bend, without moving the workpiece 24, or the workpiece 24 may be advanced and either bending tool assembly 86*a*, 86*b* can generate the next subsequent bend.

One example of forming a curve, rather than a precise angle, is illustrated in FIGS. 14D–F. Initially, as seen in FIG. 14D, bending tools 92, 94 are retracted below the surface 84 of the table 82 to avoid interference. The workpiece 24 is advanced in an indexed fashion, as described herein, to the appropriate indexed point. Large and small radius bending tools 92, 94 are positioned by actuator 104 (FIG. 9) moving the bending tool assembly casing 96 within guide slot 150 and then rotating bending tool assembly casing 96 within the tool assembly bearings 122 to allow the workpiece 24 to advance into position between the rollers 92, 94. With the bending tools 92, 94 in position relative to the workpiece 24, opposed jaws 88*b* are retracted beneath the plane of the work surface 84 and opposed jaws 88*a* are separated to no longer hold the workpiece 24. Simultaneously, drive rollers 58 advance the workpiece 24 through the large and small radius bending tools 92, 94 while the bending tools rotate within bending tool assembly casing 96 (FIG. 14E) to generate the initial curvature. Subsequently, the spool assembly 140 rotates (FIG. 14F) while the workpiece 24 continues to advance and the bending tool assembly 86 continues to rotate. As the curve becomes more pronounced, the jaws 88*a* retract to avoid interference with the workpiece 24. Coordinated movement creates the desired curve in the workpiece.

With the central processing module 80 as described, bends can be formed in the workpiece 24 in any desired sequence and in any desired shape. For example, bends can be formed in one portion of the workpiece by one set of bending tools 86*a*, while subsequently a bend can be formed in the opposite end of the workpiece by the complementary set of working tools 86*b*. As described in more detail below, the sequence of bends is established and coordinated by the controller 70.

C. Single Gantry Bending Table

As shown in FIG. 5, the present invention may also be accomplished through the use of a single gantry system. The single gantry system utilizes a movable gantry 180 containing at least one movable tool bending assembly 184 to allow positioning of the bending tools 194 as needed to effectuate desired bends throughout the work space. The single gantry system may utilize an input processing module 34, as previously described, or it may incorporate an advancement assembly 46 and clamping device 88, as previously described with respect to the central processing module embodiment. In either embodiment, the gantry and tool bending assembly may be positioned independent of the workpiece to effectuate desired bends throughout the work area. FIG. 5 discloses a single gantry system employing a centralized advancement assembly and clamping device, as well as an input processing module.

With respect to the single gantry system shown in FIG. 5, the workpiece 24 is advanced and positioned relative to the work surface 84 by drive rollers 58. The workpiece 24 may be moved either forward or rearward by the drive rollers 58. In addition, dual clamping devices 88*a*, 88*b* are provided. As a result, bends can be generated in combination with either set of clamps 88 to process opposite ends of the workpiece 24.

Figure 6:
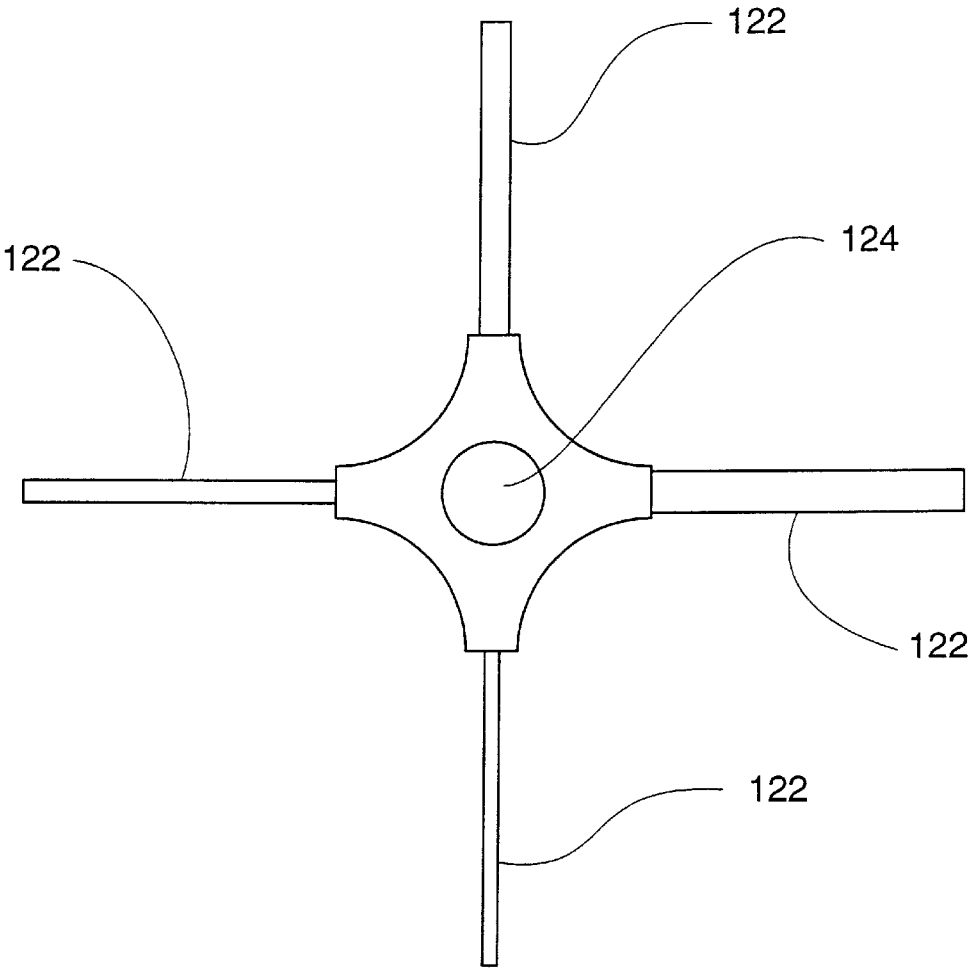
FIG. 6 is an elevated plan view of an alternative bending tool assembly.

The bending tools 194 may be individually positionable on the gantry and positioned within the work space area by vertical actuators 98, affixed to mounting blocks 198, or may be rotatably affixed to the mounting blocks 198 as shown in FIG. 6. The bending tools 194 may freely rotate or may be of the non-rotating variety.

The mounting blocks 198 ride in guide slots 190 for transverse movement relative to the work surface 84. Movement of the mounting block 198 can be accomplished through direct drive methods such as chains or timing belts, by ball screws, or by other means known to persons of skill in the art.

The gantry 180 similarly moves longitudinally within a pair of guide rails 188. As would be appreciated to one of skill in the art, gantry movement may be accomplished through ball and socket, chain drive, timing belt drive or other known methods, including step motors and worm gears.

As with the other embodiments, the single gantry system may be utilized in combination with a controller which coordinates movement of the work pieces and bending pieces to accomplish a sequence of desired bends without interference between the work piece and bending tools.

D. Bending Machine Controller

Operation of the bending machine 30 is controlled by the controller 70. The controller 70 may receive design information from the IPM 34 or other sensor. The controller may also receive feedback information from the stop sensor 40, advancing assembly 46 and/or a vision sensing system 42. The controller 70 determines the bending process based on the input information and certain bending criteria, and operates the various machine components in response to the determined bending process.

The input design information may be directly entered by an operator or may be determined based on the bar code or other identifying indicia 32. The input provides sufficient information to allow the controller 70 to determine the shapes, positions and sequence of the required bends. This information may include the stock material, the thickness of the stock, a description of the design, and information regarding the size of the design. For example, where a channel 18 of a letter housing is to be formed, the operator may enter information including the particular letter to be formed, the print style, script or font of the letter, and the size of the letter through a computer keyboard. Of course, this information may also be stored on a computer file and accessed by the controller 70 based upon a sensed input signal from the indicia 32.

As is well known, the material and its thickness may affect the total length necessary to form a shape due to compression and extension forces exerted on the metal during bending. In addition, the manner in which the stock material is stored, i.e., in coils where the inner material is subject to different stresses because it is wound tighter than the outer material, its age, the storage conditions, such as temperature, and the environmental conditions during bending, can directly effect the ability of the material to accurately form and hold a bend. This type of information, necessary for adopting the bending process, may also be stored in a computer file and readily accessed. The controller 70 may also determine that the selected sheet metal is unsuitable for the desired design.

It will be appreciated that dimensional information pertaining to commonly used print styles, scripts and fonts can also be stored in computer files for ease of use. Alternatively, measurements may be taken directly, for example, from a front plate 14 of a housing to which the channel 16 is to be fitted. Additionally, the controller 70 may obtain dimensional information for the desired design by reading external files from an external computer-aided design system or machine tool program.

The controller 70 may also receive input from an indexing or workpiece registration system, such as an optical scanner 48, for workpiece position detection. The position feedback to the controller 70 allows for adaptive processing of the bending operation. As previously stated, the indexing system may be contained in an IPM 34, as shown in FIG. 4, or may be resident in the CPM 80. Adaptive processing allows for more accurate location and formation of the bends. In this regard, it will be appreciated that many factors, such as errors in locating previous bends, inherent material characteristics, environmental conditions and material springback may cause the actual workpiece position to vary slightly from the expected position. The position feedback associated with the indexing system prevents accumulation of errors and allows for correction of errors over a series of bends. Depending upon the manner of implementation, the controller may adapt for a positioning error by recalculating the formation of a subsequent bend following the detection of an error, a post bending analysis, or may simultaneously form a bend while recalculating all subsequent processing for dynamic adaptive processing.

The controller 70 then utilizes the design input to calculate position and shape information of bends for bending the sheet metal to form the desired design. In calculating the position and shape information, the input design information may be converted onto a standard industrial format for describing designs such as letters or other geometric shapes. Generally these standard industrial formats are used to approximate the design in terms of a series of line and/or arc segments which collectively define an outline or perimeter of the design. For example, the design may be converted into the E.I.A. format, which is commonly used in the machine tool industry for driving computer numeric controller machinery, such as milling machines and the like. Other examples of standard industrial formats include the Gerber format which is commonly used in the electronics industry, and the Hewlett Packard graphics language. The format selected may depend, in part, on limitations of the machinery to be used in bending the sheet metal and characteristics of the metal. For example, certain machines cannot bend metal into continuous arcs. Accordingly, arcuate design portions may be approximated by a series of chord-like flat segments.

In order to more accurately fit the channel 16 to the front 14 and back 12 plates of the housing, the plates 12 and 14 and channel 16 may be designed using the curve generating method set forth in U.S. application Ser. No. 08/291,444, which is incorporated herein by reference. The method as set forth in that application allows a designer to design curves that are comprised entirely of line and circular arc segments that can be directly implemented by standard computer numeric controlled machinery, thereby eliminating errors that may be introduced in the process of translating the desired design for machine implementation.

The controller 70 is also operative for determining a sequence for making the bends based on certain bending criteria. Such bending criteria may account for a number of factors. First, the sequence for making the bends is selected to avoid mechanical interference between portions of the workpiece 24. As set forth in U.S. Pat. No. 5,377,516, the process for determining a feasible sequence for making the bends is generally an iterative process of selecting a candidate bend, determining whether the bend can be made without interference, and selectively assigning the bend a sequence number or selecting a new candidate bend until all bends have been assigned a sequence number. A similar iterative process can be employed to ensure that the workpiece 24 is retained within the working area of the bending machine 30 throughout the bending operation.

Other design criteria that may be factored into the process for determining the bending operation include, for example, minimizing the time and energy requirements for forming the design. In this regard, it will be appreciated that it will normally be preferred to form the bend at or near the origin, rather than at a remote location within the bending area so as to minimize gantry movement. However, with respect to particularly rigid or thick workpieces 24, it may be preferable to initiate a bend at a position remote from clamping devices 44 and work towards the origin to thereby utilize the length of the workpiece as a movement arm to reduce the force required to implement the desired bend. Accordingly, the controller 70 may also determine optimal locations for contact between the bending tools and the workpiece which may not correspond to the location of the bend. Such factors may be considered in conjunction with the feasibility determinations discussed above in determining an optimal bending process.

In implementing this process, it has been found that the computational complexity can be significantly reduced by determining the bending sequence in backwards order and then reversing the order for implementation. That is, in determining the bending sequence, the controller 70 assumes the desired final shape as a starting point. From the final shape, the controller works backwards by straightening bends and retracting an imaginary workpiece 24 through the origin into the IPM 34, while considering the above-referenced design criteria. Consequently, the controller 70 determines a sequence for taking a selected end design, straightening the design, and retracting the imaginary workpiece 24 into the IPM 34 while monitoring the operation to ensure that the workpiece 24 stays within the bending area of the bending machine 30, that mechanical interference between portions of the workpiece 24 is avoided, and that a coordinate of the workpiece 24 is always at the origin, all while minimizing the time and energy required for the process. The backwards sequence thus determined is reversed for implementation. The process is reversible and the optimized backward sequence will result in an optimal forward sequence for forming the desired shape.

The bending information thereby determined is translated by the controller 70 into control instructions for operating the bending tools of the various bending tables. Each of the bending tools of the various bending tables can be driven to any desired location along any desired curve by breaking the desired motion into linear components that can be implemented by the various drive motors. By driving the bending tools in a coordinated manner, a variety of corners, arcs and complex curves can be formed at various locations of the bending area. Moreover, these bends can be formed out-of-sequence as may be desired.

While various embodiments of the present invention have been described in detail, it is apparent that further modifications and adaptations of the invention will occur to those skilled in the art. However, it is to be expressly understood that such modifications and adaptations are within the spirit and scope of the present invention. For example, illustrations and descriptions of the disclosed embodiments have been made in the general context of a cartesian coordinate system where the work surface and workpiece are positioned in a vertical orientation relative to ground. It should be understood that the present invention can be operated in any spatial orientation.

What is claimed is:

1. An apparatus for bending a workpiece, comprising:

a first bending element for use in bending said workpiece at multiple locations along the length of said workpiece;

a second bending element for use in cooperation with said first bending element in bending said workpiece at multiple locations along the length of said workpiece;

an advancing mechanism for moving said workpiece relative to said bending elements;

a positioning means for positioning said first bending element and said second bending element relative to said workpiece and for providing at least three degrees of movement to said bending elements;

wherein the movement of said bending elements defines an operating region such that two dimensional bending can be performed on said workpiece without said workpiece being removed from said operating region.

2. The apparatus of claim 1, wherein said first bending element comprises a first roller, a second roller, and roller selection means for selectively positioning said first or second roller in a bending position.

3. The apparatus of claim 2, wherein said first and second rollers are mounted on a rotatable support and said means for selectively positioning comprises means for rotating said support.

4. The apparatus of claim 1, wherein each of said first and second bending elements comprises a rotatable roller.

5. The apparatus of claim 1, wherein one of said first or second bending elements comprises a clamp for fixedly engaging said workpiece during said bending operation.

6. The apparatus of claim 1, wherein said positioning means is operative for positioning said first bending element relative to a third axis transverse to said first and second axes.

7. The apparatus of claim 1, wherein said positioning means is operable to provide relative movement between said first and second bending elements.

8. The apparatus of claim 1, further comprising advancement means for advancing said workpiece to a selected location within said operating region.

9. The apparatus of claim 8, further comprising sensing means, disposed in predetermined relation to said advancement means, for reading encoded information regarding said workpiece.

10. The apparatus of claim 9, wherein said encoded information comprises instructions for processing said workpiece.

11. The apparatus of claim 1, further comprising feedback means, associated with said first bending member, for providing feedback information regarding one of a position and a shape of said workpiece, comparison means for comparing said feedback information to stored information, and controller means for recalculating all subsequent processing of the workpiece and for adaptively controlling said bending elements and positioning means to correct for errors overall subsequent processing of said workpiece.

12. The apparatus of claim 11, wherein said feedback means comprises sensor means for providing feedback information regarding one of a position and a shape of said workpiece and pattern recognition means for employing said feedback information together with stored pattern information to determine a location for said bending operation.

13. The apparatus of claim 1, further comprising controller means operatively associated with said positioning means, for receiving design commands regarding a desired design for said workpiece and providing bending information for forming said desired design.

14. The apparatus of claim 13, wherein said controller means comprises means for determining bending information for forming a bend of said desired design, said bending information including one of a position or a shape of said bend.

15. The apparatus of claim 14, wherein said bending information comprises a sequence for forming a series of bends of said design.

16. An apparatus for bending a workpiece, comprising:

a central tool assembly, a first bending tool assembly and a second bending tool assembly; a plane of operation within which said bending tool assemblies bend the workpiece; and a positioning means for positioning the first bending tool assembly and the second bending tool assembly relative to the central tool assembly, the positioning means operative for moving the first bending assembly and second bending assembly within said plane of operation relative to a first axis and relative to a second axis transverse to the first axis so as to provide at least two dimensional positioning of the first bending assembly or the second bending assembly relative to the central tool assembly, the positioning means also operative for moving the first and second bending tool assemblies out of the plane of operation so as to provide a third dimension of positioning of the bending tool assemblies relative to the central tool assembly.

17. The apparatus of claim 16, wherein said positioning means comprises an actuator.

18. The apparatus of claim 16, wherein said first and second bending tool assemblies rotate in relation to the workpiece.

19. The apparatus of claim 17, wherein said central tool assembly includes advancement means for positioning the workpiece at a selected location.

20. The apparatus of claim 19, wherein said positioning means is operable to provide relative movement between said bending tools and said advancement means.

21. The apparatus of claim 19, wherein said advancement means is a pair of rotatable drive rollers.

22. The apparatus of claim 17, wherein the central tool assembly includes at least one clamp assembly, comprised of a first clamp jaw having a top surface and a second clamp jaw having a top surface.

23. The apparatus of claim 22, wherein said positioning means is operable to provide relative movement between said first clamp jaw and said second clamp jaw.

24. The apparatus of claim 19, further comprising sensing means, disposed in predetermined relationship to the advancement means, for reading information regarding the workpiece.

25. The apparatus of claim 24, wherein the information is encoded.

26. The apparatus of claim 25, wherein the encoded information comprises instructions for processing the workpiece.

27. The apparatus of claim 16, further comprising controller means operatively associated with the positioning means, for receiving design commands regarding a desired design for the workpiece and providing bending information for forming the desired design.

28. The apparatus of claim 27, wherein the controller means comprises means for determining bending information for forming a bend of the desired design, the bending information including one of a position or a shape of the bend.

29. The apparatus of claim 28, wherein the bending information comprises a sequence for forming a series of bends of the design.

30. In an apparatus for bending a workpiece into a desired shape, the apparatus including a clamping assembly for holding the workpiece, and means for moving the workpiece relative to the clamping means, a bending tool assembly comprising:

a. a pair of rollers disposed on parallel and independent axes, said rollers movable toward and away from each other along a linear path;

b. said axes disposed within a tool housing, said tool housing rotatable through 360° of rotation, each of said rollers movable along its axis to extend from and retract into said housing;

c. said tool housing disposed within a spool assembly, said spool assembly defining a linear slot within which said tool housing moves, said spool assembly rotatable through 360° of rotation;

whereby said rollers are positionable relative to the workpiece to bend the workpiece into a desired shape without moving the workpiece.

31. An apparatus for bending a workpiece into a desired shape, the apparatus comprising:

a. a clamping assembly for holding the workpiece, said clamping assembly centrally disposed relative to a horizontal work surface and capable of vertical movement into and out of the plane of the work surface;

b. a workpiece advancement mechanism for moving the workpiece relative to the clamping assembly, said workpiece advancement mechanism disposed adjacent said clamping assembly and also capable of vertical movement into and out of the plane of the work surface;

c. a pair of bending tool assemblies disposed radially outwardly from said clamping assembly, said bending tool assemblies movable arcuately relative to the workpiece, said bending tool assemblies comprising a pair of rollers independently movable relative to each other.

32. The apparatus of claim 31, wherein said bending tool assemblies are vertically moveable into and out of the plane of the work surface.

33. The apparatus of claim 32, wherein said bending tool assemblies are rotatable through 360° of rotation relative to said clamping assembly.

34. The apparatus of claim 32, wherein said bending tool assemblies move toward and away from said clamping assembly.

* * * * *